US005893411A

United States Patent [19]

Nir

[11] Patent Number: 5,893,411

[45] Date of Patent: Apr. 13, 1999

[54] THREE FLUID HEAT EXCHANGER

[76] Inventor: Ari Nir, 2600 Netherlands Ave., Bronx, N.Y. 10463

[21] Appl. No.: 08/780,366

[22] Filed: Jan. 9, 1997

Related U.S. Application Data

[63] Continuation-in-part of application No. 08/615,809, Mar. 14, 1996, Pat. No. 5,626,102.

[51] Int. Cl.[6] ..... F28D 7/10

[52] U.S. Cl. ..... 165/140; 122/7 R

[58] Field of Search ..... 165/140; 122/7 R

[56] References Cited

U.S. PATENT DOCUMENTS 573,111 12/1896 Shepard ..... 165/40
686,313 11/1901 Mann ..... 165/40

*Primary Examiner*—Noah P. Kamen
*Attorney, Agent, or Firm*—Ilya Zborovsky

[57] ABSTRACT

A heat exchanger has a first tube bundle for circulating a first fluid, a second tube bundle for circulating a second fluid, and a shell which accommodates the tube bundles arranged in series in the shell, so that when a third fluid is circulated through the shell it successively contacts the tube bundles for a successive heat exchange between the third fluid and a respective one of the two first-mentioned fluids, to provide a heat transfer between three fluids.

3 Claims, 9 Drawing Sheets

THREE FLUID HEAT EXCHANGER

CROSS-REFERENCE TO A RELATED APPLICATION

This application is a continuation-in-part of the patent application Ser. No. 08/615,809 filed on Mar. 14, 1996 now U.S. Pat No. 5,626,102.

BACKGROUND OF THE INVENTION

The present invention relates to a heat exchanger for exchange between fluids.

Heat exchangers of the above mentioned general type are known in the art. In known heat exchangers one fluid is supplied through a tube bundle arranged in a shell of a heat exchanger, while the other fluid is supplied into the shell of the heat exchanger so that a heat transfer is performed between the two fluids. It is important to increase intensification of the heat transfer between the fluids.

SUMMARY OF THE INVENTION

Accordingly, it is an object of the present invention to provide a heat exchanger which has an improved intensification of a heat exchange between the fluids.

In keeping with these objects and with others which will become apparent hereinafter, one feature of the present invention of the resides, briefly stated, in a heat exchanger provided with two tube bundles for circulation of a first fluid and a second fluid, and a shell which accommodates the tube bundles in series with one another and through which a third fluid is circulated to be brought into a heat transfer with the first mentioned two fluids, so that a heat transferbetween three fluids is performed.

When the heat exchanger is designed in accordance with the present invention, it provides for a substantially intensified heat exchange between the fluids.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
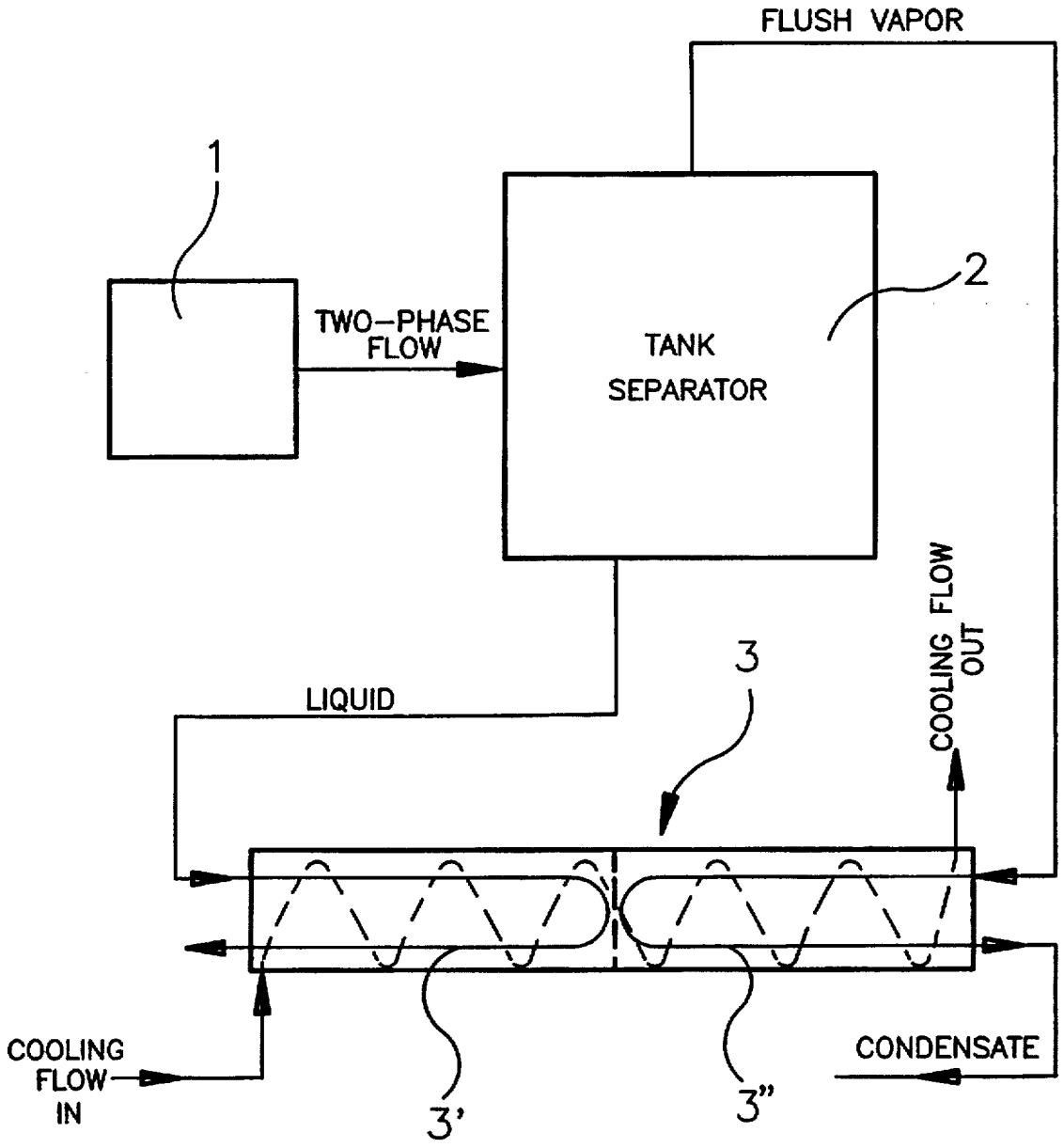
FIG. 1 of the drawings is a view schematically showing a heat exchanger in accordance with the present invention.

FIG. 1 shows a heat transfer which includes a source of a two-phase flow, for example a boiler. A tank separator 2 is connected to the source of the two-phase flow, in which the flow is subdivided into two fluids having different phase states, in particular into liquid and vapor. If the source 1 is a boiler, the tank separator 2 subdivides the liquid supplied from the boiler into a blow down water and a flush steam.

The system is provided with a heat exchanger which is formed in accordance with the present invention and identified as a whole with reference numeral 3. The liquid (the blow down water) is supplied from the tank separator into a left part 3' of the heat exchanger which is provided with a first tube bundle, and flows through the tube bundle so as to be discharged at the end, for example into a sewage. The fluid supplied in the left tube bundle can be a fluid which does not change its phase state, and in particular is liquid. The vapor (flush steam) is supplied to a right portion 3" of the heat exchanger provided with a second tube bundle and flows through the second tube bundle in which it condenses. The fluid in the tube bundle in the right portion 3" of the heat exchanger 3 is a fluid which changes its phase state. A third fluid which is a cold flow to be heated in this case can be a make up water, is supplied into a shell which surrounds both tube portions located in series with one another, so that the cold flow first flows around the left tube bundle located in the left part 3' of the heat exchanger, then flows around the right tube bundle arranged in the right part 3" of the heat exchanger, and then is withdrawn from the shell. In the example with the heat exchanger from the boiler, the heated flow or the make up water supplied for example with a temperature 40° is heated in the left part 3' of the heat exchanger by heat exchange with the hot blow down water supplied for example with temperature of 230° C. that the make up water is heated for example to 60°. When thereafter the make up water flows in the right part 3" of the heat exchanger and a heat transfer is performed with the flush stream, for example with temperature of 230°, the make up water is heated further.

Figure 2:
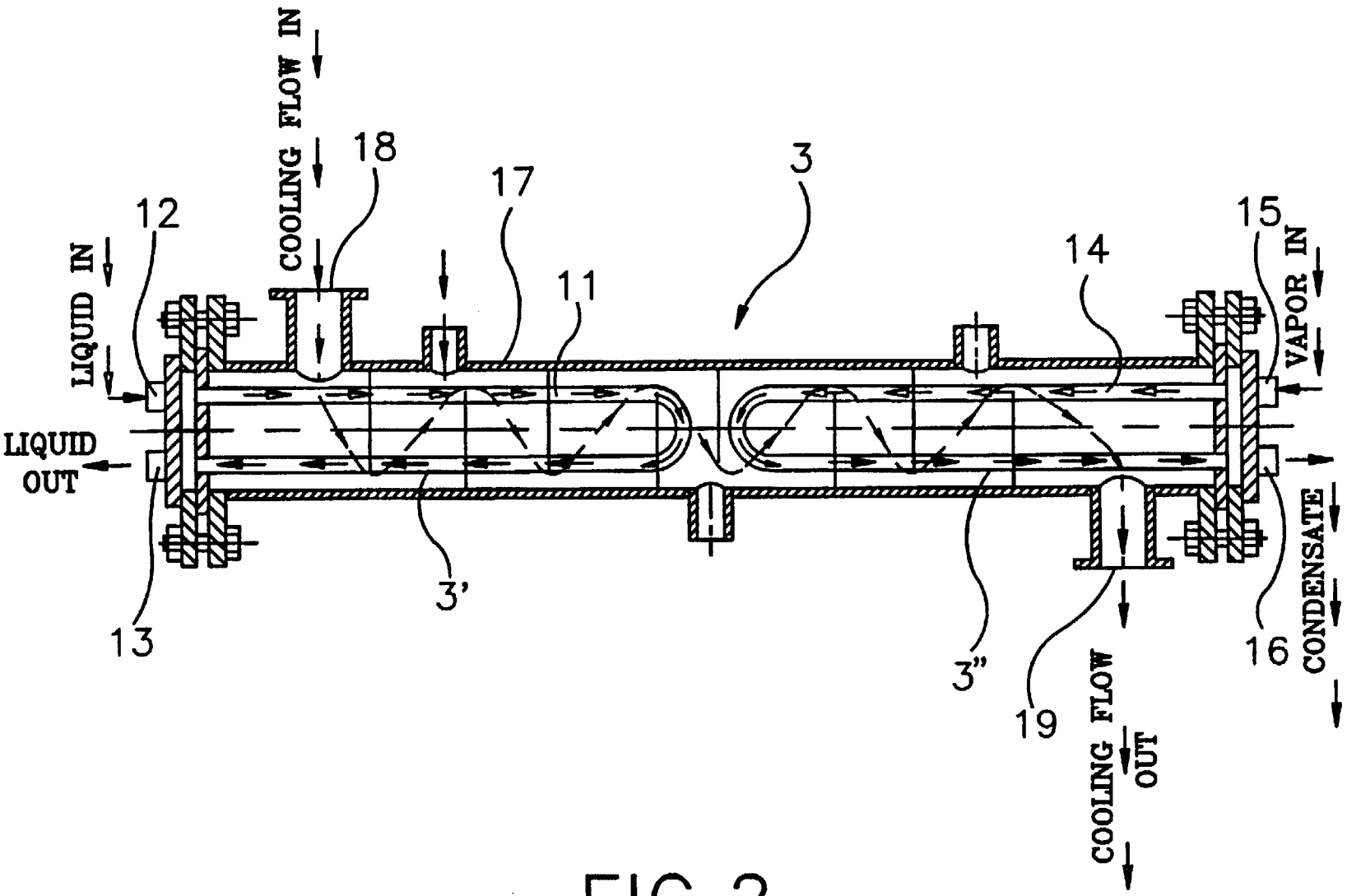
FIG. 2 is a view showing an inventive heat exchanger in more detail.

FIG. 2 shows details of the heat exchanger in accordance with the present invention. Here, the left tube bundle is identified as a whole with reference numeral 11 and has a fluid inlet 12 and a fluid outlet 13, the right tube bundle is identified with reference numeral 14 and has a fluid inlet 15 and a fluid outlet 16, and the shell is identified with reference numeral 17 and has a fluid inlet 18 and a fluid outlet 19.

It should be mentioned that the fluid which changes its phase state can be utilized further. In particular, the condensate produced from the vapor in the right tube bundle can be not only discharged, but also can be supplied back to a line leading to the source 1 of the two-phase flow or to another line in which the liquid which does not change its phase state flows.

Figure 3:
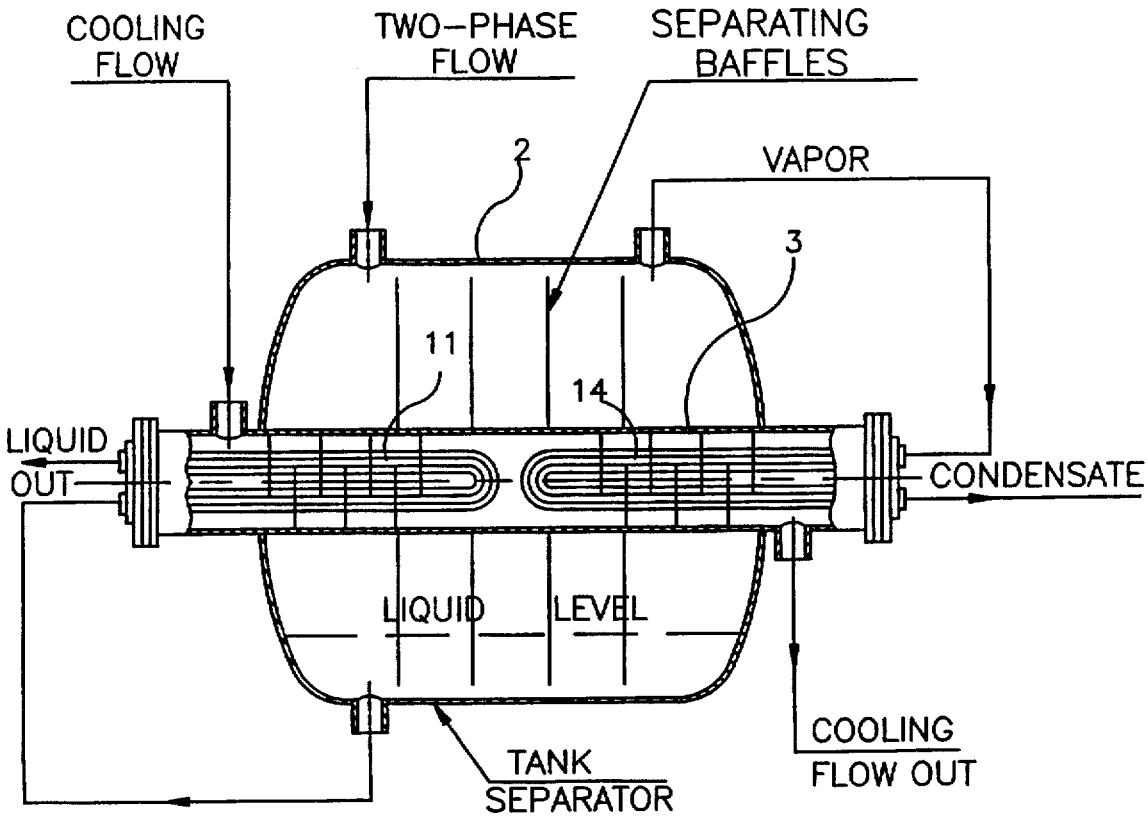
FIG. 3 is a view showing a further modification of the heat exchanger in accordance with the present invention.

The heat exchanger shown in FIG. 3 substantially corresponds to the first embodiment of the present invention. In this embodiment, however, the heat exchanger is arranged directly in the tank separator 2. This simplifies the overall construction of the heat exchanger in which the heat exchanger of the present invention is used.

Figure 4:
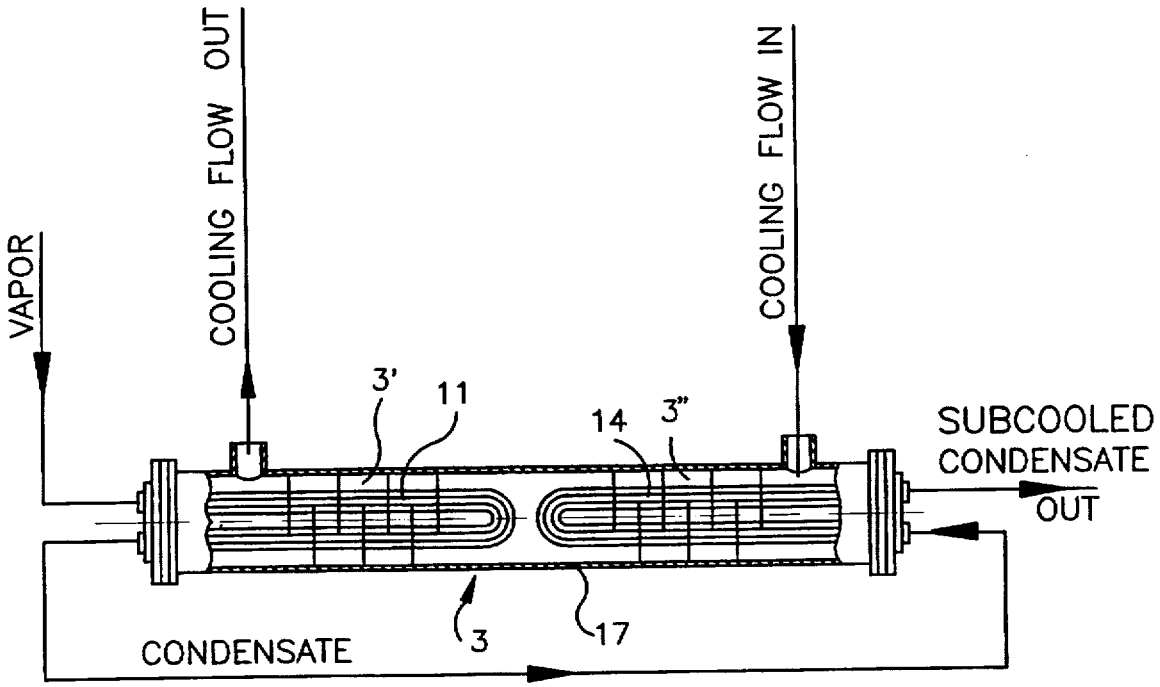
FIGS. 4–9 are views showing further modifications of the heat exchanger of the present invention.
Figure 5:
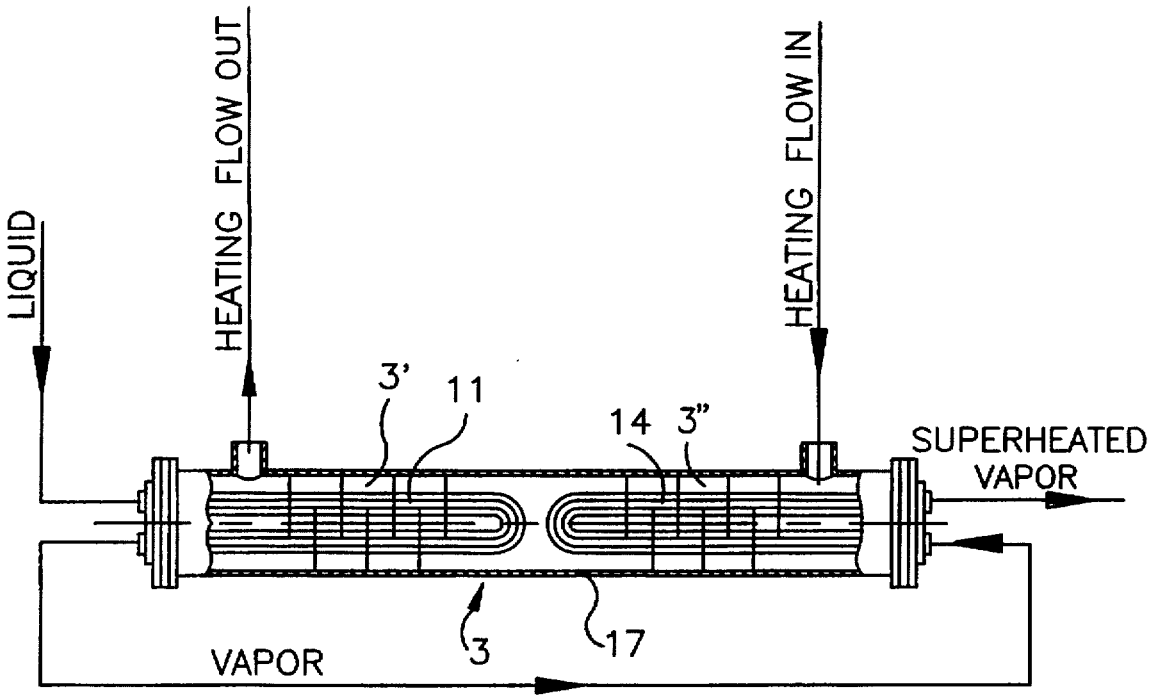

While in the embodiment of FIG. 1 the fluid which passes through the left part 3' of the heat exchanger and does not change its phase state and the fluid which passes through the right part 3" of the heat exchanger and changes its phase state are the fluids produced from the same source, in particular from the two-phase flow, FIG. 4 shows the system in accordance with another embodiment. In the system shown in this figure, vapor which is a fluid which changes its phase state, is supplied into the tube bundle 11 located in the left part 3' of the heat exchanger. The vapor is condensed in the tube bundle 11, and then as a liquid which does not change its phase state, is supplied into the tube bundle 14 located in the right part 3" of the heat exchanger and is cooled in the tube bundle 14. In all above described embodiments, the third fluid is a cold fluid to be heated which is circulated through the heat exchanger to cool the other two fluids and to be heated. In the embodiment of FIG. 4, similarly to the previous embodiments, the third, cold fluid is circulated inside the shell 17 so that again it is first brought in a heat transfer with the fluid which does not change its phase state and thereafter is brought into heat exchange with the fluid which changes its phase state In the system shown in FIG. 5 the third fluid is a heating fluid which is circulated inside the shell 17 so as to heat the other two fluids and to be cooled. In this heat exchanger the third fluid is brought into a heat transfer first with a fluid which changes its phase state and thereafter is brought into a heat transfer with a fluid which does not change its phase state. An initial flow through the tube bundles is provided by a liquid which is first supplied into the tube bundle 11 located in the left part 3' of the heat exchanger and is heated into the tube bundle 11 to evaporate. The vapor is then supplied into the tube bundle 14 located in the right part 3" of the heat exchanger and is superheated there.

Figure 6:
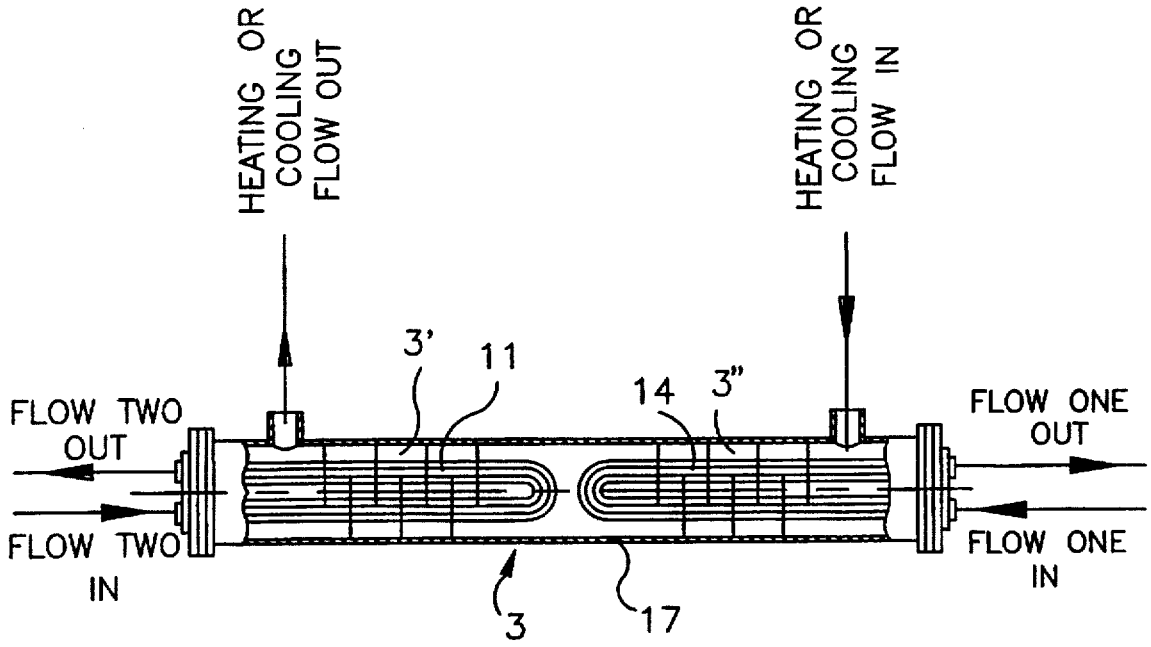
Figure 7:
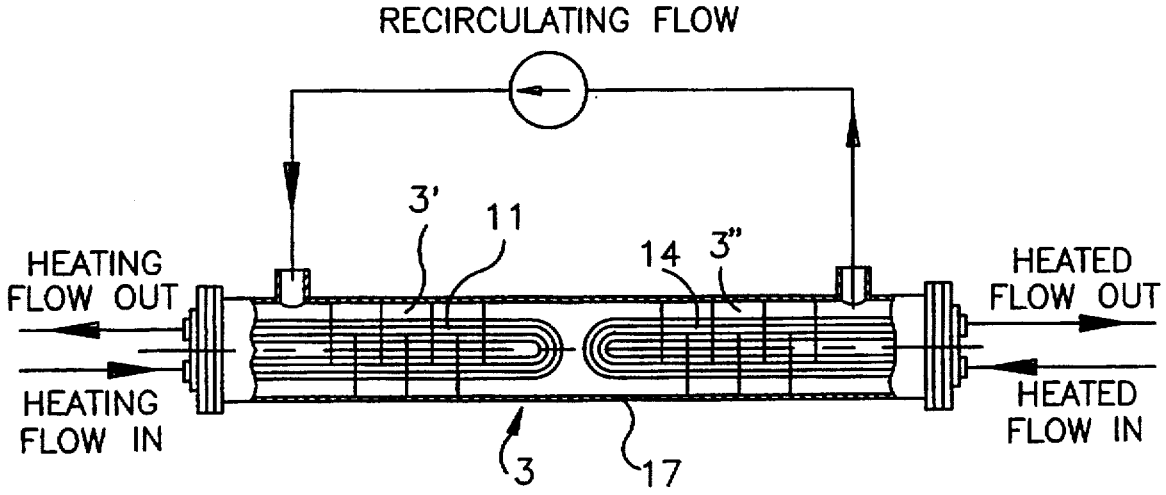

In the embodiments of FIGS. 6 and 7, the first fluid and the second fluid flow independently from one another. The first fluid is supplied into and withdrawn from the tube bundle 14 located in the right part 3" of the heat exchanger, while the second fluid is supplied into and withdrawn from the tube bundle 11 located in the left part 3' of the heat exchanger. The third fluid cools or heats the fluid in one tube bundle and in the other tube bundle. In addition, in the embodiment of FIG. 7 the third fluid is recirculated for example, by a recirculating pump to cool the fluid in one bundle and to heat in the other by heat transfer between the fluids in the bundles.

Figure 8:
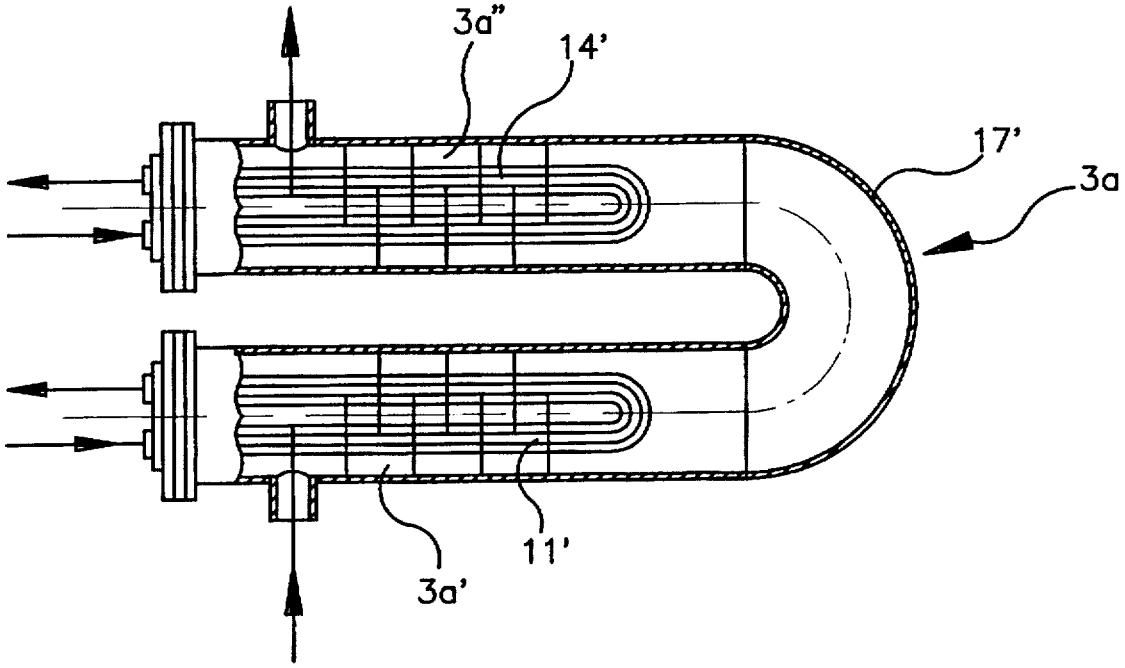

The heat exchanger shown in FIG. 8 has a first tube bundle 11" and a second tube bundle 14" which are arranged one after the other or in other words in series with one another in the parts **3*a*' and 3*a*" of the heat exchanger 3*a*. The third fluid is circulated through the interior of the shell 17". Here, however, the heat exchanger 3*a* is U-shaped. More particularly, its shell 17' is bent in a U-shaped manner, and the tube bundles 11' and 14'** are located in the corresponding legs of the U-shape. In this construction the fluid inlets and outlets of the tube bundles and the shell are located at one side of the heat exchanger, and therefore servicing of the heat exchanger as well as its repair and maintenance are facilitated.

Figure 9:
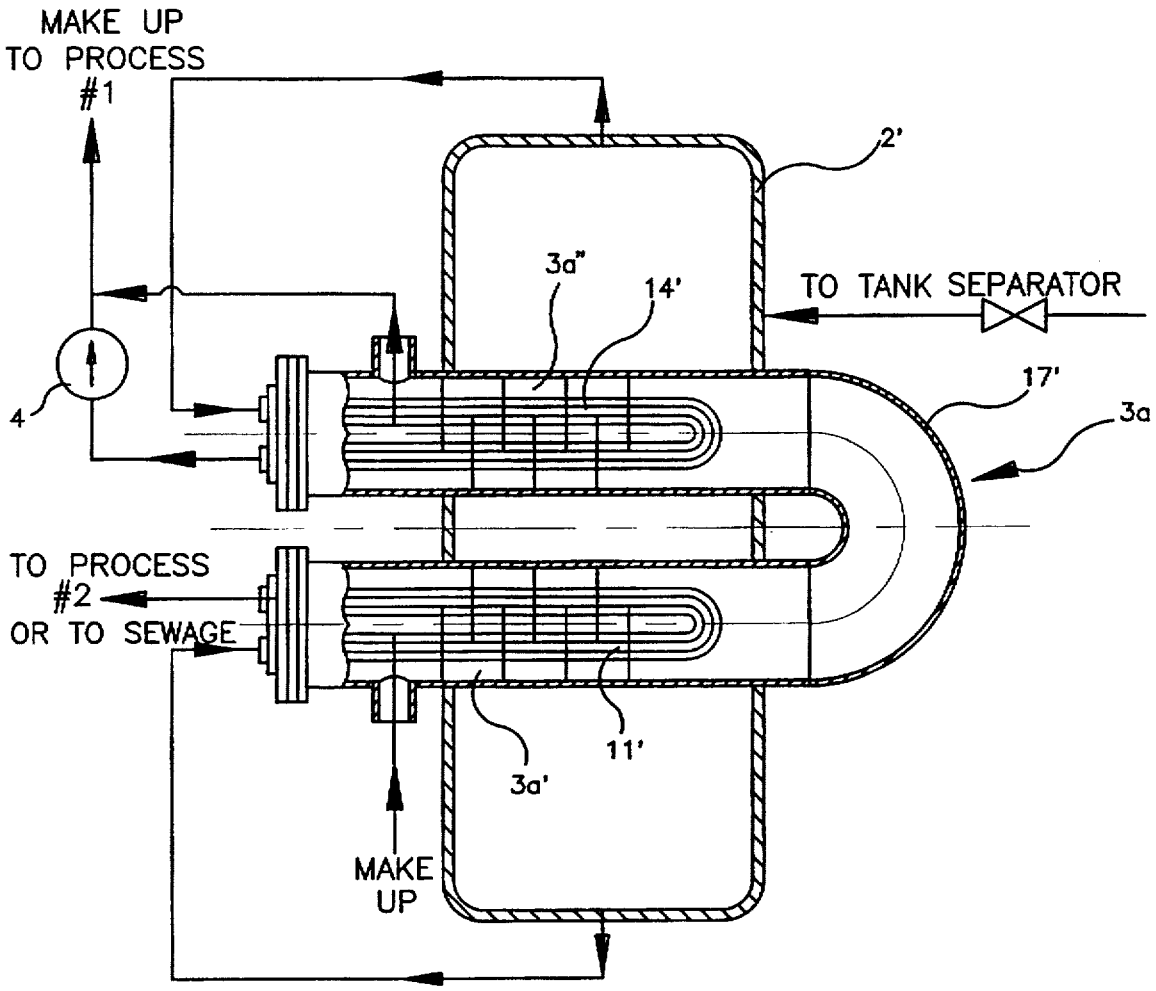

Finally, the embodiment of FIG. 9 shows a heat exchanger which substantially corresponds to the heat exchanger shown in FIG. 3, but is provided with a heat exchanger of FIG. 8. In particular, the heat exchanger **3*a* here is U-shaped and arranged in the tank separator 2'. Also, here a pump 4** is provided for recirculating of the liquids back into a liquid line of this system.

It should be mentioned that the two fluids which are circulated in the two bundles can be fluids of the same chemical substance, for example a water flow and a steam flow. On the other hand, these two fluids can be formed by flows of different chemical substances, for example an ammonia vapor flow and a water flow, etc.

It will be understood that each of the elements described above, or two or more together, may also find a useful application in other types of constructions differing from the types described above.

While the invention has been illustrated and described as embodied in heat exchanger, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A heat recovery system comprising a source of a first fluid; a first tube bundle having a first inlet and a first outlet arranged so that said first fluid is introduced from said source of said first fluid into said first inlet, passes through said first tube bundle, and is then withdrawn from said first outlet; a source of the second fluid; a second tube bundle having a second inlet and a second outlet arranged so that said second fluid is introduced from said source of said second fluid into said second inlet, passes through said second tube bundle is then withdrawn from said second outlet; a source of a third fluid; and a shell which accommodates said first and said second tube bundles and has a shell inlet and a shell outlet arranged so that said third fluid is introduced from said third source of said third fluid into said shell inlet, passes through said shell in contact with said first tube bundle and second tube bundle for a successive heat transfer between said third fluid and said first and second fluids, and thereafter is withdrawn from said shell outlet, so that all said three fluids are supplied from external thermal sources to conduct a heat transfer between said three fluids and thereafter all said three fluids are withdrawn for heat recovery.

2. A heat recovery system as defined in claim 1, wherein said shell has an axis and extends substantially in an axial direction and has two axial ends, said tube bundles being arranged substantially in said axial ends of said shell and spaced from one another in an axial direction.

3. A heat recovery system as defined in claim 1, wherein said shell is substantially U-shaped and has two leg portions connected with one another, said tube bundles being arranged in said leg portions and each being provided with a fluid inlet and a fluid outlet located at one side of the heat exchanger.

* * * * *